United States Patent [19]

Cardinal

[11] Patent Number: 4,831,939

[45] Date of Patent: May 23, 1989

[54] SECURITY SCREEN

[75] Inventor: Michael J. Cardinal, St. Albans, Australia

[73] Assignee: Saftell Pty. Limited, Victoria, Australia

[21] Appl. No.: 115,898

[22] Filed: Nov. 2, 1987

Related U.S. Application Data

[63] Continuation of Ser. No. 758,121, Jul. 23, 1985, Pat. No. 4,748,914.

[30] Foreign Application Priority Data

Jul. 23, 1984 [AU] Australia ..... PC6162
Sep. 28, 1984 [AU] Australia ..... PC7386

[51] Int. Cl.[4] ..... E06B 9/26
[52] U.S. Cl. ..... 109/17; 299/31
[58] Field of Search ..... 109/17; 91/452, 5, 451; 299/43, 31; 60/415, 413

[56] References Cited

U.S. PATENT DOCUMENTS 1,354,048 9/1920 Lindstrom ..... 109/17
4,432,665 2/1984 Stuckmann et al. ..... 299/31 X

*Primary Examiner*—David A. Scherbel
*Assistant Examiner*—Richard E. Chilcot, Jr.
*Attorney, Agent, or Firm*—Larson and Taylor

[57] ABSTRACT

A security screen having two rams to operate the screen which are located against the panel of the screen, the rams being connected at one of their ends substantially symmetrically relating to the center of the screen at or adjacent the top thereof and, at their other ends, substantially symmetrically relative to the screen to a structure beneath or beside the screen, the connections being such as to permit at least a degree of rotation of the rams relative to the panel and the structure, the arrangement being such that, as the rams are extended, the outward component of forces of the rams are substantially equal and opposite, the resultant being an upward component which can drive the screen upwardly rapidly.

We also provide a brake assembly for a security screen system whereby gas displaced by the movement of the ram piston can be passed to atmosphere by an arrangement including a valve which is held to its seat directly or indirectly by gas at a pressure substantially equal to that applied to the ram whereby the screen can move its full distance even under reduced pressure to the underside of the ram.

We also provide for a security screen system a quick opening pneumatic valve having three passages therein, one of which is common and in contact with a reservoir, the second being connected to a source of gas whereby the reservoir can be charged and the third being an outlet passage whereby gas can pass from the reservoir, the second and third passages having valve seats and a valve member which can selectively close one of the passages and normally being biased to one of the valve seats.

5 Claims, 5 Drawing Sheets

2

15
14
16
18
12
19'
17
19
10

11
12
13
21
24
23
10
20
25
2

SECURITY SCREEN

This is a continuation of application Ser. No. 6/758,121 filed July 23, 1985 , now Pat. No. 4,748,914.

This invention relates to security screens and, in particular, to an improved security screen for use in such applications as tellers' booths in banks, building societies and the like, and to a pneumatic system adapted for use with such screens.

Security screens are usually pneumatically operated and, conventionally, comprise a pair of spaced panels which are normally located below the bench or counter level and which have a pneumatic ram located therebetween and connected between the upper portion of the panels and the floor or the like, the ram, on actuation, driving the screen upwardly so as to obscure the open area in the bench through which the teller or other person normally operates.

The ram is conventionally located centrally of the screen and extends directly therebelow.

Generally, users of security screens require the screen to have a travel which is substantial relative to the height of the counter, in one example it is required that the screen, when in position, provides an overall protective height of 2 meters and, in order to effect this, it has been conventional that the height of the bench at which the teller operates must be 1.125 meters so that a ram body located between the screen panels can, when extended, locate the upper surface of the screen at the required height.

This has been considered to be somewhat unsatisfactory as ergonomic studies have shown that an optimum height for a bench for work by persons such as tellers is 1.025 meters and it has not been possible, without very substantial reconstruction of the building beneath the location of the screen, to provide security screens which can be used with a bench of this height but still give an overall height of 2 meters of protection.

Further, conventional security screens are normally raised and lowered by a single central ram and it has been found that such screens can cope with only very little variation from true vertical of the rails on each side on which the screen runs and, as such, the time involved in fitting the screens can be great.

In applications where security screens are to be used, for example, in the front of tellers cages in banks, it is essential that the screen be able to be moved extremely rapidly and it is also a requirement that the screen be of a very substantial material so as to be able to withstand, say, a pistol shot or a shotgun blast from short range. For example, where such screens are to be used in banks, it is not unusual for the screen itself to be of a material which weighs approximately 120 kg and a desiderata as far as movement is that the screen will move a distance of 1 meter in 0.4 second from initiation by a teller.

Conventionally, and as described earlier herein, the way of effecting such movement is to use a pneumatic system where a pneumatic ram of substantial diameter is rapidly charged with gas, normally air, to cause the movement of the screen.

A major problem, as will be appreciated, is stopping the screen when it reaches the top of its movement.

There have been proposed methods which do this and, normally, they require the use of a relief valve which opens to permit the discharge of gas from the top of the cylinder once the pressure goes above a predetermined value and, when the pressure drops to this value, the valve again closes and there can only be a relatively small leakage of gas and the remaining gas acts as a resistance to further upward movement of the piston.

Whilst such systems can be satisfactory where the screen is operating under all of its normal parameters, it cannot satisfactorily cope with a situation, for example, where the pressure driving the piston is less than the optimum and, under such arrangements it may well be that the screen simply does not reach the top of its movement, as the gas pressure below the piston cannot overcome the pressure above the piston.

Also, in previously proposed systems, switching of the gas to the ram has necessitated the use of large diameter valves and these are, in themselves, expensive and may necessitate the use of relatively expensive switching means.

A first object of the present invention is to provide a security screen which permits an increased total distance of movement of the screen in a predetermined bench height and another, related, object is to provide such a screen which is adapted to take into account slight variations from the vertical of the guide rails and which can also be adjusted to provide a required rest position.

A secondary object is to provide a pneumatic system for operation of security screens and it is a further object of the invention to provide a relief valve means to act as a brake in such a system and in other systems and, also, to provide a new form of inlet valve.

The invention, in its broadest sense includes, a security screen having two rams located adjacent the panel of the screen, the rams being connected, at their one ends, substantially symmetrically relative to the centre of the screen at or adjacent the top thereof and at their other ends, substantially symmetrically relative to the screen, the points of connection of the said other ends being spaced by a spacing greater than the points of connection at the said one ends, the connections being such as to permit at least a degree of rotation of the rams relative to the panel and the structure, the arrangement being such that, as the rams are extended, the outward component of forces of the rams are substantially equal and opposite, the resultant being an upward component which can drive the screen upwardly rapidly, the rams, during extension, rotating about their connections.

In a second aspect, the original extensions of the rams can be adjusted so that the rest position of the screen is parallel with the upper surface of the bench or the like with which it is associated.

The arrangement is such that, if the rails or the like in which the screen moves are not parallel or vertical, the mode of connection of the rams can compensate, at least to a certain degree, for this.

The invention, in its secondary aspect comprises a brake assembly for a security screen system including at least one pneumatic ram the assembly including means whereby gas displaced by the movement of the ram piston can be passed to atmosphere by two different routes, one of which comprises a valve held to its seat by gas at a pressure substantially equal to that applied to the ram whereby, when the gas above the piston is at a pressure greater than that applied to the piston, then the valve is displaced and the air can be vented to atmosphere and, when the pressure above the piston is at a pressure equal to or less than the pressure below the cylinder, then the valve closes and there is pressure equalization, opposing the movement of the piston, and the piston is braked.

Preferably there is an adjustable bleed valve through which a quantity of gas can pass to anable the piston to assume its position of maximum movement after a time which depends on the degree of bleed through the valve.

Preferably the working gas for the system is air.

The invention, in another aspect, comprises a quick opening valve arrangement having three passages therein, one of the passages being in contact with a reservoir, the second passage being connected to a source of gas whereby the reservoir can be charged and the third being an outlet passage whereby gas can pass from the reservoir to a working pneumatic ram or the like, characterised in that the second and third passages have valve seats, there being a valve member which can selectively close one of the passages, the valve member being normally biassed to close the third passage.

The bias may be by means of a spring acting against the valve member.

Preferably there is a bypass from the reservoir to the downstream side of the third passage whereby, on passage of gas therethrough, the valve can be moved from its seat to permit gas to be passed rapidly from the reservoir, through the third passage, to the ram or the like.

The invention also includes a security screen system which includes the brake assembly and/or the quick opening valve arrangement.

In order that the invention may be more readily understood, we shall describe, in relation to the accompanying drawings, one particular embodiment of the screen of the invention.

Figures 1, 3:
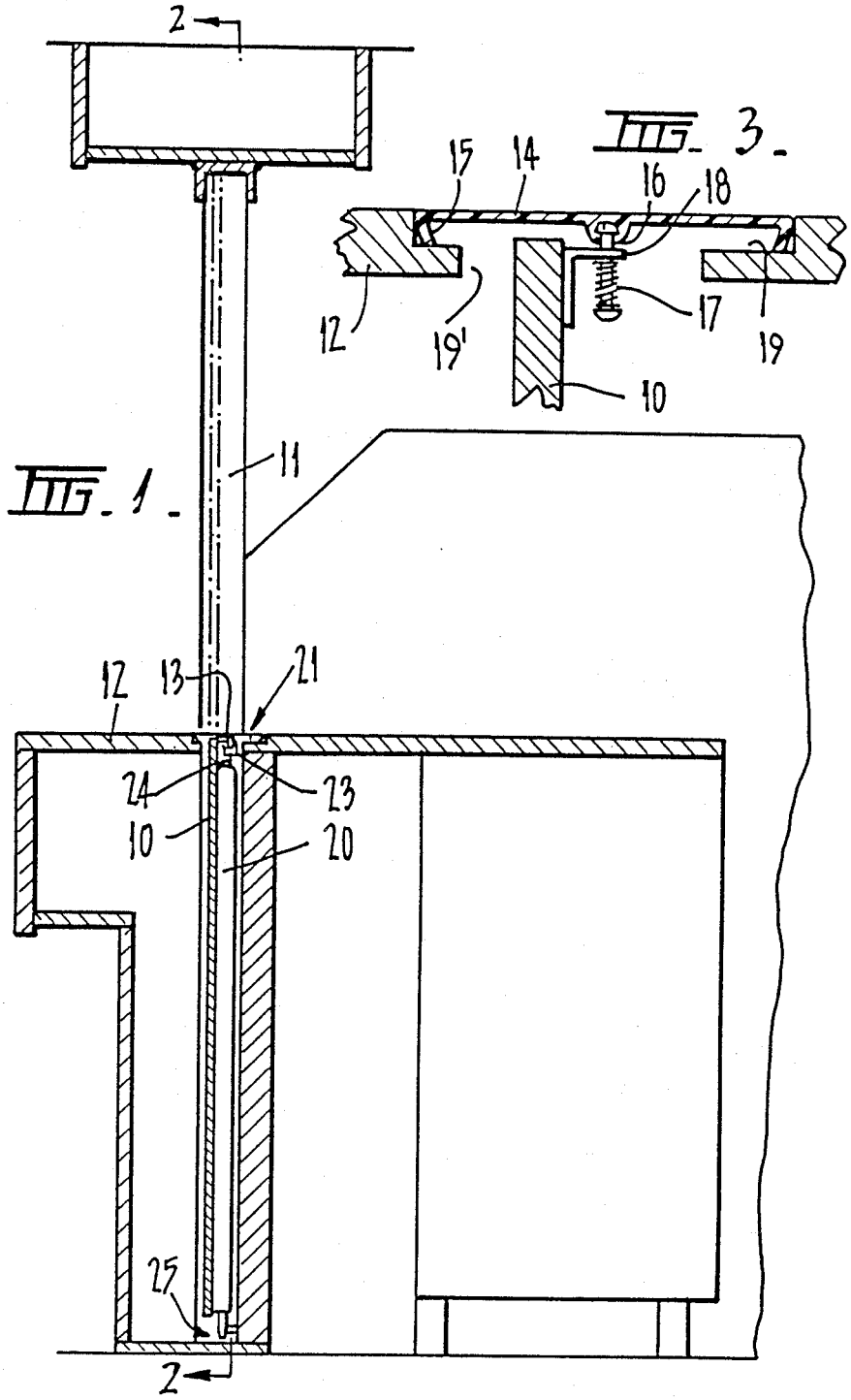
FIG. 1 is a sectional side elevation of a security screen having the features of the invention with the screen being shown retracted.
FIG. 3 shows one means of terminating the upper end of the screen so that, when in its normal position, it provides a substantially flush upper surface to the bench or counter.
Figure 2:
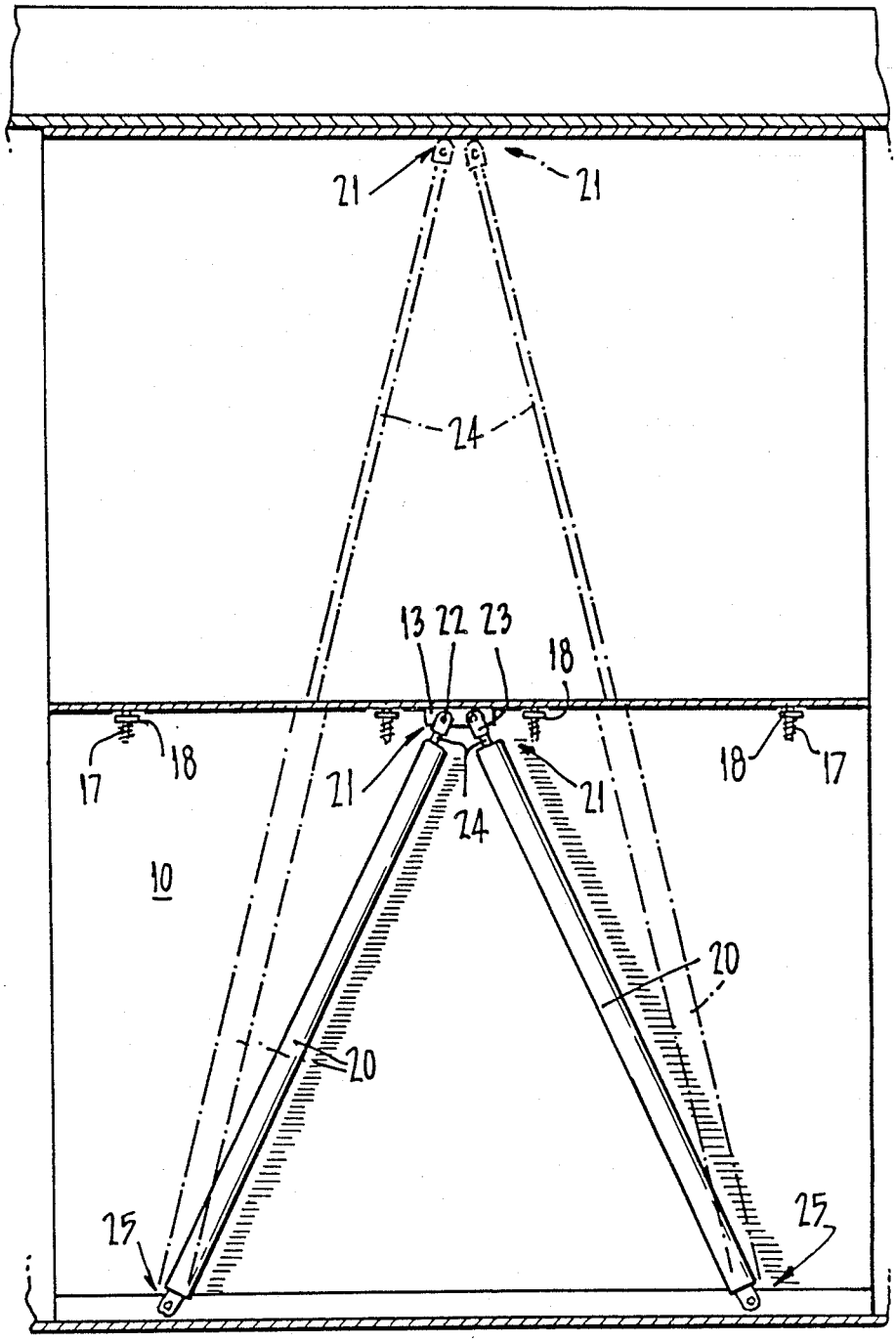
FIG. 2 is a partial longitudinal section showing the orientation of the screen and the rams associated therewith when it is in its normal, retracted position and also showing the final position of the rams when the screen is extended.

Referring to FIGS. 1 to 3, the screen 10 itself and the rails 11 in which it can run can be considered to be conventional although, as will be discussed later herein, these may need not necessarily be as accurately formed as has been the case with previous screens.

The major difference in the screen of the invention from previous screens is that, instead of using a single, central, pneumatic ram we use a pair of pneumatic rams 20, which are best illustrated in FIG. 2.

Conventionally, the single ram used may have a diameter of approximately 76 mm but, in the invention, the pair of rams 20 may each have a diameter of approximately 50 mm. This, amongst other things, enables a screen which is thinner and bench aperture which is narrower than normal to be used as, as can be seen from FIG. 1, the screen 10 and the rams 20 are closely located and together fit in a recess in the bench 12. The width of this recess is then dependent on the diameter of the rams.

Each of these rams is pivotally connected at one end 21 to the screen adjacent the top thereof. The connection may be by a pivot pin 22 passing through a yoke 23 on the shaft 24 of the ram attached to the ram piston and a lug 13 attached to and extending from the screen 10. The pivot pins 21 are closely adjacent the centre point of the screen with the spacing between these rams being approximately 60 mm.

The rams, which may be approximately 900 mm long, when retracted, extend outwardly and downwardly and are connected, again by pivotal joints 25, to the floor or part of the structure directly beneath the screen.

It will be seen that, when the rams are actuated, their components of outward force are effectively opposite and equal so there is a resultant upward component which drives the screen upwardly.

Whilst the operation of the rams is not as efficient as would be the case if they were mounted vertically, it will be appreciated that the total upward force of the two smaller diameter rams is sufficient so the operation of the screen still meets the normally specified requirements, as far as speed of movement is concerned.

It will also be seen that, because of the pivotal connection of the two rams, should there be any variations in the tracks 11 in which the screen runs, it is possible for the screen to be able to compensate for these and, thus, there is less likelihood of the screen jamming on the tracks, even if these are not directly parallel and, specifically, if they are not vertical than has been the case with previous screens.

In fact, if the tracks are effectively parallel but are away from the vertical, the screen will still move effectively, whereas, with more conventional screens, the screen would jam and be unable to fully close the aperture in front of the teller.

Further, it will be seen that there is the possibility of adjusment of the rest position of the screen using the arrangement of the invention as, by simply altering the effective retracted length of one or other of the rams, so the top of the screen can be moved into a parallel alignment with the bench top and, even though this effectively has the rams at two different lengths, as soon as the rams are actuated, they will drive upwardly and any variation will be compensated for during the movement. One way of adjusting the length of the ram may be by adjusting the position of the yoke 23 which screws onto the shaft 24 of the piston.

As illustrated in FIGS. 1 and 3, but best in FIG. 3, lying across the top of the screen 10 there is a cover member 14 which may be made of an aluminium extrusion, but which could also be of a synthetic plastics material.

This cover member 14 serves two different purposes.

Firstly, by its shape and the way it is mounted to the screen 10, it can account for certain variations in the location of the screen relative to the aperture 19' in the top 12 of the bench.

The member 14 has inwardly directed downturned edges 15 and its width is effectively equal to the width of a recess 19 formed in the top of the bench 12. Thus, if initially, the cover member could be considered to be free, it will be appreciated that, if it is located over the recess 19 out of direct alignment therewith, one of the downwardly and inwardly directed edges 15 would strike an edge of the recess and the member would be guided towards its final required position.

It is able to do this when fitted to the screen 10 because of the form of mounting adopted.

It will be seen from FIG. 2 and 3 that a number of lugs or the like 18 are provided, which lugs extend outwardly from the screen and passing through these lugs are studs or the like 16 which can enter a recess in the cover member 14 so as to be attached thereto. Springs 17 are located over the studs 16 and under the lugs 18 to provide resilience of connection to the upper end of the shutter.

Thus, it will be seen that, as the screen moves downwardly to its rest position, should the cover member 14 be displaced at any place along its length, it will tend to be moved into the recess, because of the angle of the member 15 which contacts the edge of the recess and, as the screen continues to move downwardly, so the springs 17 are compressed to firmly locate the member 14 in the recess.

On the other hand, when the screen is moved upwardly, the lugs 17 strike the underside of the extension on the cover member and the cover member moves upwardly with the screen.

This serves the second purpose referred to.

It will be appreciated, from the earlier part of this description, that the screen, when moving upwardly, moves upwardly very rapidly and is also of a substantial weight, so it has very substantial energy during its movement.

If the upper edge of the screen 10 was effectively exposed, which has been the case in some previous forms of security screens, and, should portion of a person, such as an arm of the intruder, be extending across the aperture in which the screen moves, great physical damage can be done to that person. The extra surface area given by the cover plate 14 will minimise the possible damage to the person, as the force to the person will be spread over a more substantial area than would be the case if the cover plate was not provided.

It will be seen that, when the rams reach their extended position, the screen, which can be considered to be floating until it reaches this position, is locked and the screen in its final position is thus secure against downward movement by any person.

It can thus be seen that the screen of the invention has five inherent advantages over previously proposed screens.

The first is that, as the rams in their rest position are at an angle to the vertical, the total head space needed to occupy the rams is substantially less than is the case where the rams are vertical and, as such, the bench height under which the screen is located can be lower than previously and it is quite satisfactory to use a bench height of 1.025 meters, which is considered to be the optimum height.

Secondly, because of the various forces in effect when the rams are operating and the pivotal connection of the rams, so the screen can move in tracks which would not be satisfactory for a standard screen and so, any minor error in initial location of the tracks or any movement in the tracks due to building settling or the like, can readily be accommodated by the screen without affecting its movement.

Thirdly, when the screen is in its upper position, it is effectively braced by the two angled rams at equal and opposite angles and is thus effectively locked into its required location.

Fourthly, it is possible to adjust the rest position of the screen relatively simply without involving any difficulties in respect of later movement of the screen.

Fifthly, the arrangement of the cover plate can compensate for variation of the recess in the bench top in which it is received and for variation in the location of the screen.

A further commercial advantage of the screen of the invention is that it is cheaper than conventional screens. Somewhat surprisingly, the cost of two smaller diameter rams is less than the cost of one larger diameter ram and, because the extreme accuracy of the rails, which is necessary for a single ram screen, does not necessarily have to be maintained, the time involved in assembling and locating the compoments may well be somewhat less than in the case of more conventional screens.

Referring now to FIGS. 4 to 8, we shall describe a pneumatic system to operate security screens, which system is particularly suitable for a screen as described in FIGS. 1 to 3, but which is also suitable for single ram systems.

Figure 8:
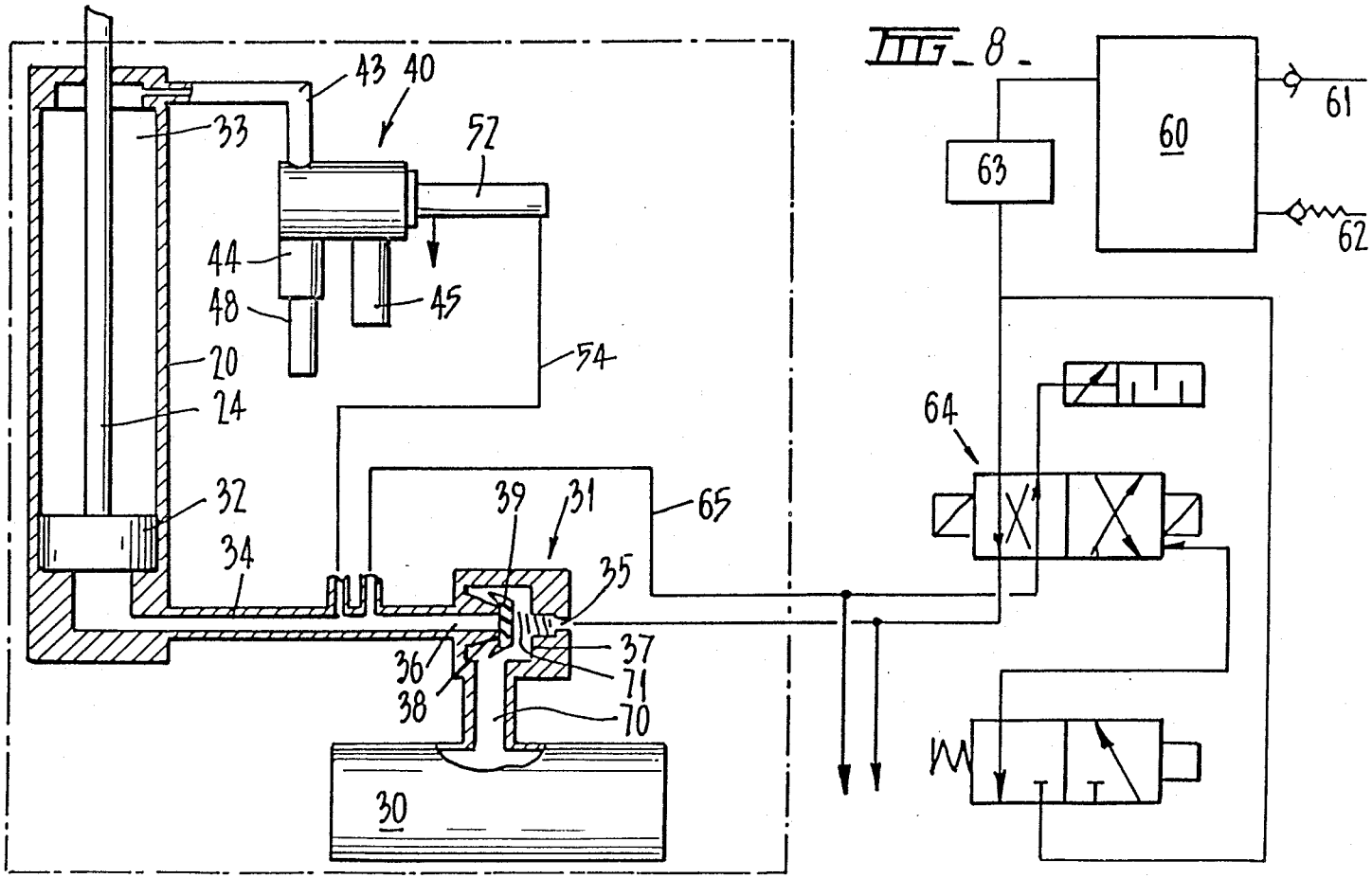
FIG. 8 is a largely schematic view showing an alternative arrangement of the invention which is adapted for use in respect of multiple screens.

FIGS. 4 to 7 are illustrative of a practical configuration for use with a single screen arrangement, whereas FIG. 8 is a schematic view of a complete system which is adapted to have a plurality of screens. However, the components of the two systems are functionally similar and similar referance numerals will be used in respect of the two systems and the description, where appropriate, can be applied to each system.

Figures 4, 7:
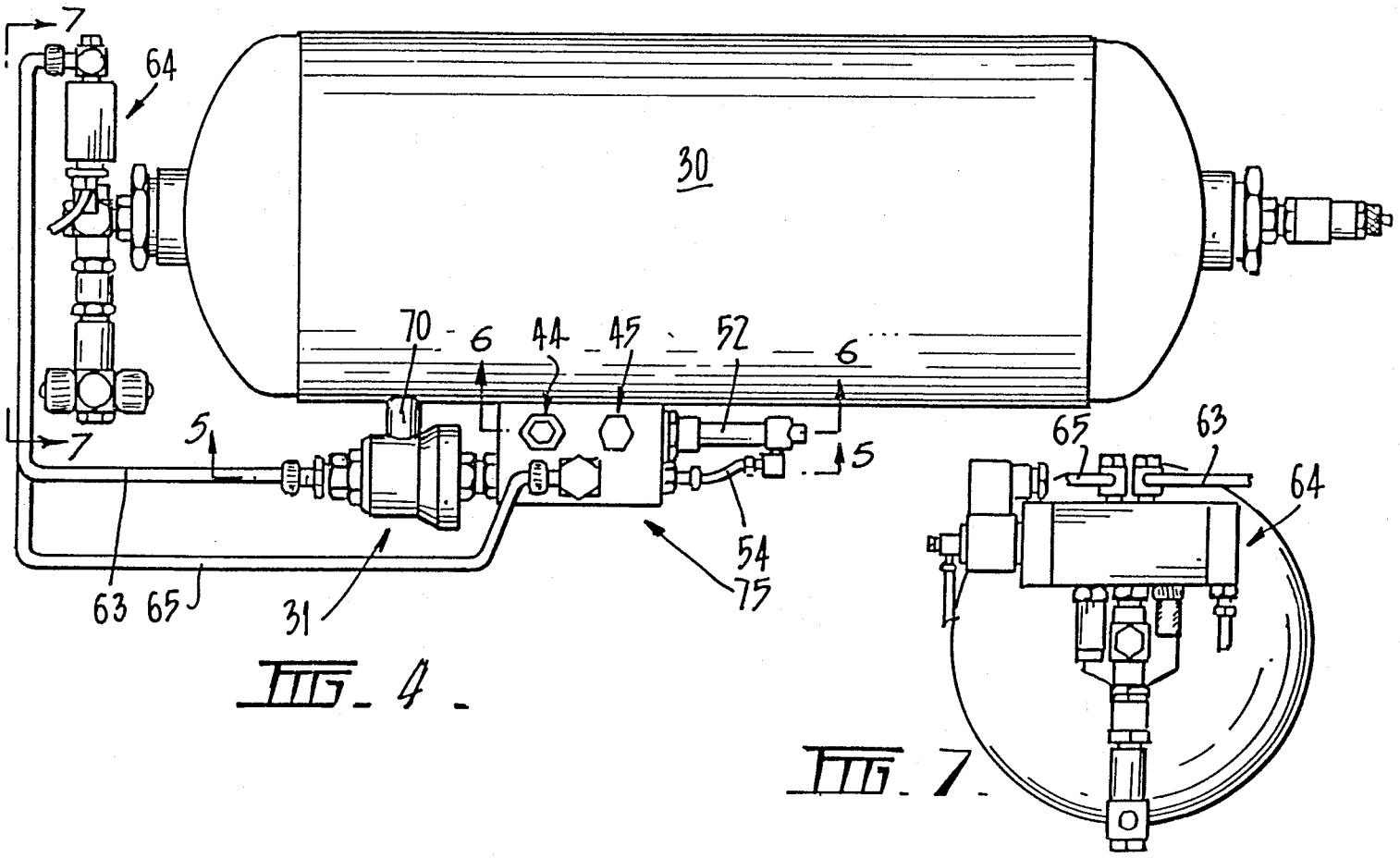
FIG. 4 shows an illustrative view of a air or other gas reservoir having attached thereto the various components of the operating system for a single screen system.
FIG. 7 is an end view looking along line 7—7 of FIG. 4.
Figure 5:
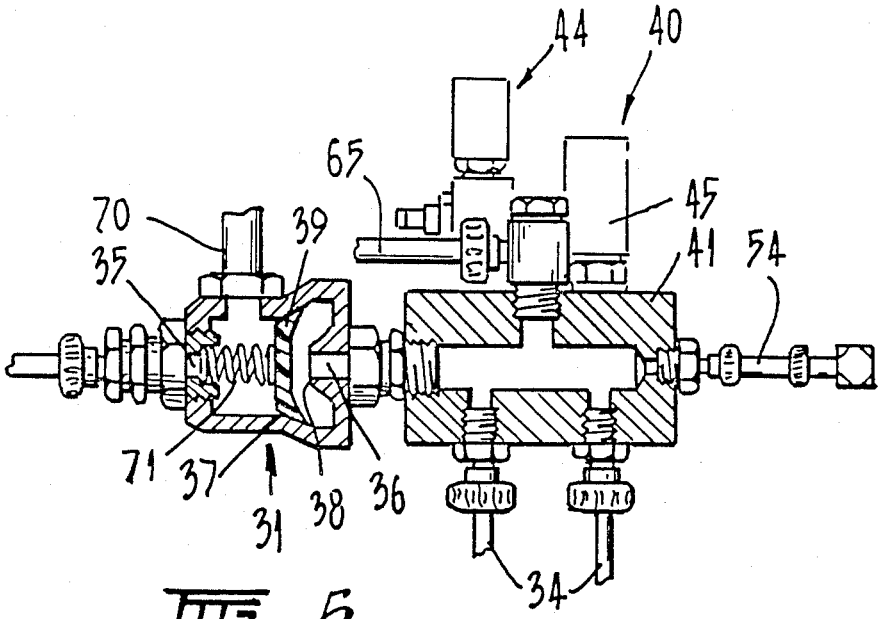
FIG. 5 is a view along line 5—5 of FIG. 4 looking in the direction of the arrows.

Associated with each ram 20 is an gas reservoir 30 which is maintained at a predetermined pressure. In the arrangement of FIG. 4, as will be described hereinafter, the reservoir 30 acts as the receiver from the compressor, whereas, in the arrangement is FIG. 8, the reservoir is charged from a separate receiver. Means are provided which are accessable to the teller or other operator, whereby a valve 31 located between the reservoir and the ram can be caused to open to permit rapid ingress of air from the reservoir 30 into the ram cylinder 21 beneath the piston 32 thereof so that the screen is caused to move rapidly upwardly. As described, a desiderata of such movement is 0.4 seconds for a movement of approximately 1 meter. Such components, in broad terms, are conventional.

There is also normally provided a means whereby, when the screen reaches close to the upper end of its movement it is braked, and it will be appreciated that the screen developes very substantial momentum during its upward movement, so the braking effect has to be substantial.

It is not unconventional that this braking is effected by restricting the outflow of air from above the piston, whereby there is a build up of pressure above the piston which pressure, when braking is effected, equals the pressure driving the piston upwardly.

We provide an improved means whereby this braking can be effected.

This means comprises a composite vent valve assembly and relief valve assembly shown as 40 in FIG. 8 and is part of a composite sub-assembly shown as 70 in FIG. 4.

Figure 6:
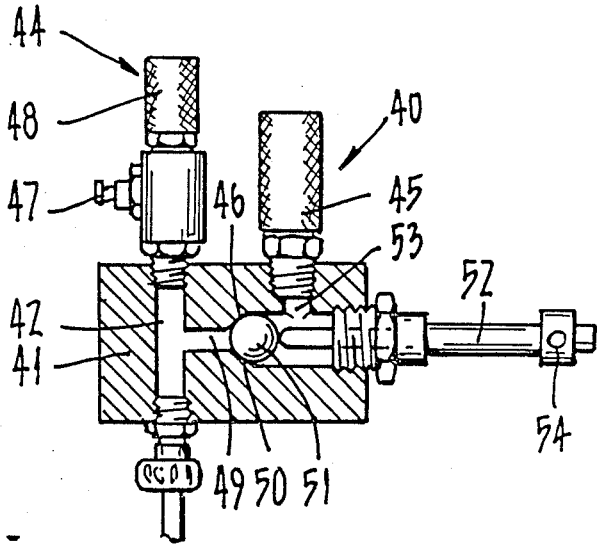
FIG. 6 is a view along line 6—6 of FIG. 4 looking in the direction of the arrows.

The assembly 40 may be mounted in a single block or be part of a composite block 41 illustrated in FIG. 6. Functionally, the two arrangements are the same. The block may have a bore 42 therethrough, one end of the bore being internally threaded to permit connection by way of a pipe 43 to the upper end 33 of the cylinder of the ram and the other end being threaded to permit the connection thereto of a bleed valve 44.

The bleed valve 44 may be of any known type and is preferably provided with adjustment means 47 whereby the throughput of air can be readily controlled, and a silencer 48.

The relief valve assembly may comprise a silencer 45 connected to an output passage 53 and a non-return valve 46.

The non-return valve is located in a passage 49, which is connection with passage 42, and is arranged to permit flow of air in one direction and operates under the conditions described later herein.

The passage 49 is provided, part way along its length, with a valve seat 50, the valve being a ball 51 which is adapted to be held against its seat by means of a piston rod extending from the cylinder of a pneumatic ram 52.

The output passage 53 is located on the downstream side of the ball 51.

This arrangement is such that, when the ball 51 is away from its seat, there can be a virtually unrestricted flow of air through the passage 42 in the body, past the seat 50 and to exhaust through the silencer 45 by way of passage 53.

When the valve is on its seat, it will be appreciated that the only gas flow can be through the bleed valve 47 and, depending upon the setting of this valve, so the rate of flow is controlled.

The ram 52 associated with the valve is in connection by line 54 with the line 34 to the underside of the ram 20 which operates the screen.

In operation, and we shall assume air operation, when air is applied to the ram 20, air at the same pressure is applied to the ram 52 on the brake assembly and, thus, the ball 51 comprising the valve member, is driven against its seat 50 and is held in this position.

As the ram piston 32 moves upwardly in its cylinder, it will be appreciated that the substantial volume of air in this cylinder, the cylinder being somewhat more than 1 meter long, will be compressed and there will be a movement of this air from the cylinder into the relief valve assembly by way of line 43 and a certain portion of the air will be permitted to pass through the bleed valve 47.

However, as previously indicated, the rate of movement of the piston 32 in the ram 20 is extremely high and the pressure build up is extremely rapid, and all the air cannot pass through the bleed valve 47 os there is an overall pressure build up in passage 42.

When the pressure in the relief valve passage 42 reaches a value at which the force developed by this pressure acting on the ball 50 is greater than the force applied to the ball by the piston of the ram 52, then the ball will be displaced from its seat and there can be a rapid passage of air to exhaust through passage 53 at the silencer 45 and the effective resistance to the upward movement of the ram will be equivalent to that emanating from the force applied to the ball by the ram 52.

However, as the ram gets closer to the top of its movement, and the air volume is less, there will come a time when the pressure on the piston of the ram 52 will overcome the pressure of the air against the ball 51 member and the ball member will move towards its seat 50 and there will be a build up of pressure within the area defined by the top 33 of the upper portion of the cylinder of the ram and the pipe 43 and the passage 42 in the relief valve.

This pressure build up will continue until there is effectively a balancing of pressures beneath and above the piston 32 in the ram and, at this time, the ram will be braked to a stop. The actual operating parameters can, of course, be controlled by the relative size of the aperture 49 passing through to the valve seat and the diameter of the cylinder of the ram 52 acting against the valve and, to a certain extent, the opening of the bleed valve.

The operation, as so far described, can be considered to be analagous to the normal operation of conventional systems, and this is correct.

However, in a normal system, should there be any substantial variation in the pressure of air entering the ram beneath the piston, then the operation of the system fails. For example, if the pressure is substantially reduced, the relief valve above the piston will not open, and the screen will only move a certain distance and will then stop before the piston has come to the end of its movement because the pressure above the piston has come to equal the pressure attempting to drive the piston.

The use of the relief valve arrangement of the present invention obviates this.

Where the pressure driving the piston 32 of the ram 20 is reduced, as may be the case if air has already bled from the reservoir 30 or if there is a break in the line feeding the reservoir, then the pressure from the piston of the ram 52 holding the ball 51 against the valve seat 50 is reduced and, thus, the air from above the piston passes through the non-return valve at a lower pressure than would otherwise be the case and thus the resistance to the movement of the ram is not as great as would be the case with a conventional bleed valve. The piston can thus continue to move over its full stroke, notwithstanding the fact that there is a fall in pressure. It is in this that the valve of the present invention differs from that of previously proposed arrangements and, of course, this adds to the effectiveness of the operation of the screen under adverse conditions.

The bleed valve 44 preferably includes a one way valve which operates when the screen is to be returned to its normal condition. Under these circumstances, air can pass through the silencer 48 through the valve, not illustrated, and into the passage 42 so that air can enter above the piston and there is little resistance to the downward movement thereof.

Another aspect of the invention relates to the valve 31 by which the air is directed from the reservoir to the ram.

As previously mentioned, in conventional arrangements, it is generally necessary to have a large diameter valve to permit rapid transmission of air and this is not only expensive in itself, but may also necessitate the use of relatively expensive switching means to cause operation of the valve.

We have found, surprisingly, that we can modify a known type of quick exhaust valve to provide extremely rapid transmission of air from the reservoir to the ram.

These valves have a pair of seats 37, 38 located at opposite ends of a passage, which seats can selectively be contacted by a valve member 39, so that one or other of the passages 35, 36 is closed whilst the other is open to a common passage 70.

In one mode of operation of the device, charging air is connected at 35 to the end of the passage having valve seat 37 thereon and the line 34 to the ram is connected to the other end 36 of the passage having valve seat 38 thereon. The reservoir 30 is connected to the common passage.

In our modification of the valve, we spring bias the valve member 39 to the seat 38 by way of spring 71.

In the interconnection of the device we provide a bleed from the reservoir to the downstream side of the valve.

In FIG. 8, we show the reservoir 30 being in connection with the air source, which is shown as a receiver 60 which is in connection, by way of line 61 with a compressor and which has a safety valve 62. In FIG. 4, the reservoir 30 is directly connected, through line 61, to a compressor and the safety valve is shown connected directly to the reservoir 30. In FIG. 8, air is shown to pass through a filter regulator 63 through a main actuating valve 64 to the valve 31. In FIG. 4, no filter regulator is shown.

The operation of the main actuating valve will be described in relation to FIG. 8 and is normally in the condition shown, that is so that passage from the receiver 61 to the passage 35 is direct and continuous. As the spring 71 causes the valve 35 to close seat 38, under these circumstances the reservoir 30 is maintained charged at the pressure permitted by the regulator 60 or the compressor.

It will be noted in FIG. 8 that the left part of the Figure, which represents the actuating apparatus of a single shutter, is enclosed in chain-dash and the right portion is not so enclosed.

The components shown on the right portion are common to all of the screens of the system and the two arrows from the lines which pass through the main actuating valve 64 pass, in parallel, to the other screens.

When the system is to be activated and the valve 31 is to be operated, by operation of an actuation valve 64, air under pressure from the receiver is disconnected from the valved end 35 of the passage and is connected to the passage 34 to which the ram is connected by way of line 65 thus increasing the pressure at the end 36 causing the valve member 39 to move against the bias of the spring 71. This opens the common passage 70 to the passage 34 to which the cylinder of ram 20 is connected and, once the valve commences to open, the pressure of the air in the reservoir 30 assists the movement of the valve. At the same time, the air from the reservoir passes at high speed through the valve past seat 38 and through the line 34 to below the piston 37. Whilst this is taking place, the pressure within the valve is sufficient to hold the valve member 38 against the pressure of its spring 71 onto seat 37 and the screen operates.

At the same time the ram 52 of the braking device is acted on through line 54 by the same air source as is each ram 20 which effects the movement of the screen.

Once the movement of the screen has ceased the valve 39 is caused to move under the action of pressure of the spring 71 to the seat 38. When the actuating valve 64 is moved to its other condition, that illustrated, the pressure air again passes to the reservoir 30 from the receiver 60, and it can become recharged.

At the same time, line 50 is in connection with a bleed valve 66 and the weight of the screen, together with the operation of the one way valve in valve 44 permits the screen to move downwardly, the rate of movement being controlled by the setting of the bleed valve.

Should the screen need to be operated a second time, after only a short delay, whilst the reservoir will have only returned to part of its initial, and preferred, pressure the available air, in association with operation of the valve 40 previously described, whereby the screen can operate satisfactorily at a pressure less than its optimum pressure, would permit the screen to satisfactorily be re-used and to enable the screen to reach the top of its movement.

Preferably, all the screens of the particular installation are adapted to operate at the same time and, if required, there may be an actuating means which causes actuation of the valve 64 associated with each teller's position. To facilitate this, the valve 64 may be an electrically operated valve.

In FIG. 8, we have shown, schematically, an alternative actuating valve 67, which may be an hydraulic valve, and which can provide a method of operating valve 64 if, for example, there was a power failure.

I claim:

1. A security screen apparatus comprising a security panel comprising a top and a bottom and having a center line, and two rams located adjacent said panel of the screen and each including first and second ends, the rams being connected, at the first ends thereof, substantially symmetrically relative to the center line of the panel substantially at the top of the panel and being connected, at the second ends thereof, to a structure which supports the rams, substantially symmetrically relative to the center line of the panel, the points of connection of one of the said ends of the rams being spaced by a spacing greater than the points of connection at the other of the said ends thereof, and the connections being such as to permit at least a degree of rotation of the rams relative to the panel and the structure, the arrangement being such that, for the security panel to be raised to become effective, the rams are caused to extend together and, as this extension occurs, the outward component of forces of the rams are substantially equal and opposite, the resultant being an upward component which can drive the panel upwardly rapidly, the rams, during extension, rotating about their connections.

2. A security screen as claimed in claim 1 wherein the spacing of the rams at the said first ends thereof is less than the spacing of the rams at the said second ends thereof.

3. A security screen as claimed in claim 1 wherein the original extensions of the rams can be adjusted so that the rest position of the panel can be set to a desired height.

4. A security screen as claimed in claim 1 wherein there is a cover member associated with the panel, the plane of said cover member extending at substantially right angles to the plane of the panel and said cover member being spring loaded for movement relative to the panel whereby, when the panel is lowered, the cover member may be received in a recess.

5. A security screen as claimed in claim 4 wherein the edges of the cover member are inturned so that, if the cover member is out of alignment with the recess when the panel is lowered, the edge which first strikes the recess will cause the cover member to move relative to the recess so as to be engaged therein.

* * * * *